US006638579B2

(12) United States Patent
Ross et al.

(10) Patent No.: US 6,638,579 B2
(45) Date of Patent: Oct. 28, 2003

(54) PROCESS OF MAKING PAPER MACHINE SUBSTRATES RESISTANT TO CONTAMINATION BY ADHESIVE MATERIALS

(75) Inventors: Russell Frederick Ross, Lilburn, GA (US); Ali Yahiaoui, Roswell, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/208,219

(22) Filed: Jul. 30, 2002

(65) Prior Publication Data

US 2003/0049469 A1 Mar. 13, 2003

Related U.S. Application Data

(62) Division of application No. 09/465,504, filed on Dec. 15, 1999, now Pat. No. 6,455,447.

(51) Int. Cl.[7] ..... C08J 7/04

(52) U.S. Cl. ..... 427/503; 427/496; 427/551; 427/595; 442/76; 442/94; 442/164; 442/168; 442/170; 442/172

(58) Field of Search ..... 427/503, 496, 427/551, 595; 442/76, 94, 164, 168, 170, 172

(56) References Cited

U.S. PATENT DOCUMENTS

| | | | |
|---|---|---|---|
| 3,188,165 | A | 6/1965 | Magat et al. |
| 3,849,241 | A | 11/1974 | Butin et al. |
| 3,892,575 | A | 7/1975 | Watts et al. |
| 4,012,303 | A | 3/1977 | D'Agostino et al. |
| 4,340,057 | A | 7/1982 | Bloch et al. |
| 4,340,563 | A | 7/1982 | Appel et al. |
| 4,350,731 | A | 9/1982 | Siracusano |
| 4,376,013 | A | 3/1983 | Wang |
| 4,439,481 | A | 3/1984 | Johnson et al. |
| 4,822,451 | A | 4/1989 | Ouderkirk et al. |
| 4,879,176 | A | 11/1989 | Ouderkirk et al. |
| 4,888,019 | A | 12/1989 | Gauneus et al. |
| 4,950,549 | A | 8/1990 | Rolando et al. |
| 4,954,256 | A | 9/1990 | Degen et al. |
| 5,048,589 | A | 9/1991 | Cook et al. |
| 5,073,235 | A | 12/1991 | Trokhan |
| 5,078,925 | A | 1/1992 | Rolando et al. |
| 5,094,876 | A | 3/1992 | Goldberg et al. |
| 5,100,689 | A | 3/1992 | Goldberg et al. |
| 5,156,780 | A | 10/1992 | Kenigsberg et al. |
| 5,207,873 | A | 5/1993 | Sanduja et al. |
| 5,229,172 | A | 7/1993 | Cahalan et al. |
| 5,232,600 | A | 8/1993 | Degen et al. |
| 5,273,789 | A | 12/1993 | Shinonaga et al. |
| 5,284,900 | A | 2/1994 | Izubayashi et al. |
| 5,297,590 | A | 3/1994 | Fleischer |
| 5,326,825 | A | 7/1994 | Näsman et al. |
| 5,407,713 | A | 4/1995 | Wilfong et al. |
| 5,554,414 | A | 9/1996 | Moya et al. |
| 5,643,375 | A | 7/1997 | Wilfong et al. |
| 5,709,798 | A | 1/1998 | Adiletta |
| 5,753,569 | A | 5/1998 | Michels et al. |
| 5,798,417 | A | 8/1998 | Howard, Jr. |

FOREIGN PATENT DOCUMENTS

| | | |
|---|---|---|
| EP | 0193370 B1 | 2/1990 |
| EP | 860544 A2 | 8/1998 |
| EP | 0668390 B1 | 3/1999 |
| FR | 2434235 | 3/1980 |
| GB | 820120 | 9/1959 |
| GB | 2088883 A | 6/1982 |
| GB | 2283991 | 5/1995 |
| WO | WO 9905358 | 2/1999 |

OTHER PUBLICATIONS

PCT International Seach Report Jun. 7, 2000.

C. Batich, et al., "Surface Modification I, Graft Polymerization of Acrylamide onto Low–Density Polyethylene by $Ce^{4+}$–Induced Initiation", Journal of Polymer Science: Part A: Polymer Chemistry, vol. 25, 1987, pp. 3479–3488 (No month avail.).

Patent Abstracts of Japan; 57–85826; May 28, 1982; *Cation Exchange Membrane*.

Patent Abstracts of Japan; 57–131376; Aug. 14, 1982; *Electrolyzing Method for Water*.

Patent Abstracts of Japan; 58–109141; Jun. 29, 1983; *Production of Ion Exchanger*.

Patent Abstracts of Japan; 58–198535; Nov. 18, 1983; *Cation–Exchange Membrane*.

Patent Abstracts of Japan; 01–55234; Mar. 2, 1989; *Manufacture of Polyolefin Resin Laminated Steel Sheet With High Weathering Property*.

Patent Abstracts of Japan; 01–224004; Sep. 7, 1989; *Permselective Microfilter and Its Production*.

Patent Abstracts of Japan 04–16220; Jan. 21, 1992; *Manufacture of Fluorine–Containing Filtration Membrane*.

Patent Abstracts of Japan; 04–108573; Apr. 9, 1992; *Corrosion–Resistant Multilayer–Coated Steel Sheet Pile and Its Manufacture*.

(List continued on next page.)

*Primary Examiner*—Bernard Pianalto
(74) *Attorney, Agent, or Firm*—Dority & Manning, P.A.

(57) ABSTRACT

A paper machine substrate modified to resist contamination by adhesive materials. The paper machine substrate includes: a paper machine substrate; and an active agent that is grafted to the surface of the paper machine substrate to lower the surface energy of the paper machine substrate so that the substrate resists contamination by adhesive material. The papermachine substrate may be made by a process that includes the steps of: providing a paper machine substrate; applying an active agent to the paper machine substrate; and exposing the paper machine substrate to greater than about 2 million rads (Mrad) of radiation to cause a reaction between the active agent and the substrate so the active agent becomes joined to the substrate. The active agent may be a fluorinated monomer, a fluorinated polymer, a perfluorinated polymers, or a polyalkyl siloxane.

20 Claims, No Drawings

OTHER PUBLICATIONS

Patent Abstracts of Japan; 04–108574; Apr. 9, 1992; *Corrosion–Resistant Multilayer–Coated Steel Sheet Pile and Its Manufacture*.
Patent Abstracts of Japan; 07–238125; Sep. 12, 1995; *Modifying Method for Polyolefin*.
Patent Abstracts of Europe; EP 00297741A2; Jan. 4, 1989; *Polypropylene Articles and Method for Preparing Same*.
Patent Abstracts of Europe; EP 00324483A2; Jul. 19, 1989; *Method for Forming Hard Cost on Polyolefin*.
Patent Abstracts of Europe; EP 00510503A2; Oct. 28, 1992; *Process for the Treatment of Surfaces*.
Patent Abstracts of Europe; GB 02035350A; Jun. 18, 1980; *Biocompatible Surgical Device*.
Patent Abstracts of Europe; WO 090301622A1; Jan. 21, 1993; *Polymeric Sheet*.
D.E. Bergbreither, et al., "New Approaches In Polymer Surface Modification", Journal of Plastic Film & Sheeting, vol. 12—Jan. 1996, pp. 15–26.
D.E. Bergbreither, et al., "Polypropylene Surface Modification By Entrapment Functionalization", Macromolecules, vol. 31, No. 11, 1998, pp. 3417–3423 (No month avail.).
M. Zhao, et al., "Preparation of Highly Impermeable Hyperbranched Polymer Thin–Film Coatings Using Dendrimers First as Building Blocks and Then as in Situ Thermosetting Agents", J Am. Chem. Soc., vol. 121, No. 5, 1999, pp. 923–930 (No month avail.).
M. Zhao, et al., "Effect of pH, Fluorination, and Number of Layers on the Inhibition of Electrochemical Reactions by Grafted, Hyperbranched Poly(acrylic acid) Films", Israel Journal of Chemistry, vol. 37, 1997, pp. 227–286 (No month avail.).
M. Zhao, et al., "Inhibition of Electrochemical Reactions at Gold Surfaces by Grafted, Highly Fluorinated, Hyperbranched Polymer Films", Langmuir, vol. 13, No. 6, 1997, pp. 1388–1391 (No month avail.).
Y. Zhao, et al., "Synthesis of Hyperbranched Hydrophilic Fluorinated Surface Grafts", Langmuri, vol. 12, No. 23, 1996, pp. 5519–5521 (No month avail.).
D.E. Bergbreiter, et al., "New approaches for polymer surface modification", Polymer Surfaces and Interfaces: Characterization, Modification, and Application, 1997, pp. 3–18 (No month avail.).
D.E. Bergbreither, "Surface Modification of Polymers", Chemically Modified Surfaces, 1992, pp. 133–155 (No month avail.).
"New Grafting Chemistry for Functionalized Polyethylene Films", Journal of Polymer Sciences: Part A: Polymer Chemistry, vol. 30, 1992, pp. 2049–2053 (No month avail.).
P. Michael Fletcher, "New Lower–Voltage EB Systems For Curing Polymers and Coatings", Journal of Coatings Technology, vol. 65, No. 822, Jul. 1993, pp. 61–64.
Brochure—"The Founder of Low Energy Electron Beam Technology", Energy Sciences, Inc., 1994, 2 pages (No month avail.).
Brochure—"EB: The Ultimate Solventless Converting System", Energy Sciences, Inc., 1994, 2 pages (No month avail.).
Brochure—"CB 150 Electrocurtain", Energy Sciences, Inc., 4 pages (No date avail.).
Brochure—"Electrocurtain Electron Beam Technology—Efficient In–Line Materials Processing from Energy Sciences, Inc.", Energy Sciences, Inc., 8 pages (No date avail.).
Brochure—"Electron Beam Technology—The Converting Process of the 90's", Energy Sciences, Inc., 1994, 8 pages (No month avail.).
U.S. Naval Research Laboratory Report 5265—"An Improved Device for the Formation of Superfine, Thermoplastic Fibers", K.D. Lawrence, R. T. Lucas, and J. A. Young, Feb. 11, 1959, 10 pages.
U.S. Naval Research Laboratory Report 4364—"Manufacture of Superfine Organic Fibers", V. A. Wente, E. L. Boone, and C. D. Fluharty, May 25, 1954, 18 pages.

PROCESS OF MAKING PAPER MACHINE SUBSTRATES RESISTANT TO CONTAMINATION BY ADHESIVE MATERIALS

This is a divisional of application Ser. No. 09/465,504, filed Dec. 15, 1999, now U.S. Pat. No. 6,455,447.

FIELD OF THE INVENTION

This invention generally relates to the field of paper making, and more specifically, to paper machine substrates.

BACKGROUND

Different types of pulp feedstocks may be used for making paper. Some feedstocks, such as recycled paper, often have contaminants. These contaminants include dirt and stickies. Stickies consist primarily of organic adhesives used in the paper converting industry, such as hot melts, pressure-sensitive adhesives, expanded polystyrene, and lattices. Generally, stickies include polyvinyl acetate polymers and copolymers, ethylene vinyl acetate polymers and copolymers, polystyrene, styrene-butadiene, polypropylene, polyethylene, polyamide, latex, other rubber compounds, and wax. A common source of stickies is the tackifiers added to paper products to improve adhesion properties.

Unfortunately, these stickies often adhere to the paper machine substrates, such as press felts, fabric sheets, and forming wires, that transport the pulp fibers during the paper making process. Once adhered to the paper machine substrate, the stickies may create holes in the substrate, and thus, may affect the quality of the produced paper. Furthermore, continued stickies deposition may require the replacement of the substrate, and thereby, increase production costs.

Accordingly, a paper machine substrate that resists stickies adhesion will improve over conventional paper machine substrates.

DEFINITIONS

As used herein, the term "comprises" refers to a part or parts of a whole, but does not exclude other parts. That is, the term "comprises" is open language that requires the presence of the recited element or structure or its equivalent, but does not exclude the presence of other elements or structures. The term "comprises" has the same meaning and is interchangeable with the terms "includes" and "has".

As used herein, the term "paper machine substrate" refers to a surface for transferring a layer of a different material, such as a fiber slurry or web. Examples of paper machine substrates include forming wires and press felts. Other examples of paper machine substrates include through-dryer, forming, and transfer belts as disclosed in U.S. Pat. No. 5,048,589, which is hereby incorporated by reference. Materials used to manufacture paper machine substrates include metals, such as steel or iron; mineral fibers, such as extruded glass or ceramics; natural fibers, such as wool; polymers; or mixtures thereof. Polymers used to manufacture substrates include polyolefins, such as polyethylene or polypropylene; polyamide polymers, such as nylon; and polyesters, such as polyethylene terephthalate; or mixtures thereof. Desired substrates can be made from woven polyethylene terephthalate or nylon, or alternatively, may be made from stapled substrates, such as woven polyethylene terephthalate sewn with nylon.

As used herein, the term "forming wire" refers to a screen belt or fabric on any wet-type paper machine. Liquid is drained from the pulp slurry deposited on the belt as the paper sheet is formed. Forming wires may be made of materials including metals, mineral fibers, natural fibers, polymer fibers, or mixtures thereof.

As used herein, the term "press felt" refers to a continuous belt that performs as a conveyor or transmission belt of a pulp sheet, provides a cushion between press rolls, and serves as a medium for removal of liquid from the pulp sheet.

As used herein, the term "grafted" refers to the bonding, such as covalent bonding, of one material to another. An exemplary grafting technique chemically bonds organic polymers to a wide variety of other materials, both organic and inorganic, in the form of fibers, films, chips, particles, or other shapes.

As used herein, the term "active agent" refers to a substance that grafts or bonds to a paper machine substrate. Exemplary active agents include fluorinated monomers, fluorinated polymers, perfluorinated polymers, and polyalkyl siloxanes.

The term "machine direction" as used herein refers to the direction of travel of the forming surface onto which fibers are deposited during formation of a material.

The term "cross-machine direction" as used herein refers to the direction that is perpendicular and in the same plane as the machine direction.

As used herein, the term "woven" refers a network of crossed and interlaced material.

As used herein, the term "nonwoven web" refers to a web that has a structure of individual fibers which are interlaid forming a matrix, but not in an identifiable repeating manner. Nonwoven webs have been, in the past, formed by a variety of processes known to those skilled in the art such as, for example, meltblowing, spunbonding, wet-forming and various bonded carded web processes.

As used herein, the term "spunbond web" refers to a web formed by extruding a molten thermoplastic material as filaments from a plurality of fine, usually circular, capillaries with the diameter of the extruded filaments then being rapidly reduced, for example, by fluid-drawing or other well known spunbonding mechanisms. The production of spunbond nonwoven webs is illustrated in patents such as Appel, et al., U.S. Pat. No. 4,340,563.

As used herein, the term "meltblown web" means a web having fibers formed by extruding a molten thermoplastic material through a plurality of fine, usually circular, die capillaries as molten fibers into a high-velocity gas (e.g. air) stream which attenuates the fibers of molten thermoplastic material to reduce their diameters. Thereafter, the meltblown fibers are carried by the high-velocity gas stream and are deposited on a collecting surface to form a web of randomly disbursed fibers. The meltblown process is well-known and is described in various patents and publications, including NRL Report 4364, "Manufacture of Super-Fine Organic Fibers" by V. A. Wendt, E. L. Boone, and C. D. Fluharty; NRL Report 5265, "An Improved Device for the Formation of Super-Fine Thermoplastic Fibers" by K. D. Lawrence, R. T. Lukas, and J. A. Young; and U.S. Pat. No. 3,849,241, issued Nov. 19, 1974, to Buntin, et al., which are hereby incorporated by reference.

As used herein, the term "cellulose" refers to a natural carbohydrate high polymer (polysaccharide) having the chemical formula $(C_5H_{10}O_5)_n$ and consisting of anhydroglucose units joined by an oxygen linkage to form long molecular chains that are essentially linear. Natural sources of cellulose include deciduous and coniferous trees, cotton, flax, esparto grass, milkweed, straw, jute, hemp, and bagasse.

As used herein, the term "pulp" refers to cellulose processed by such treatments as, for example, thermal, chemical and/or mechanical treatments.

As used herein, the term "slurry" refers to a liquidity, such as watery, mixture or suspension of insoluble matter, such as pulp.

As used herein, the term "fiber" refers to a fundamental solid form, usually crystalline, characterized by relatively high tenacity and an extremely high ratio of length to diameter, such as several hundred to one. Exemplary natural fibers are wool, silk, cotton, and asbestos. Exemplary semi-synthetic fibers include rayon. Exemplary synthetic fibers include spinneret extruded polyamides, polyesters, acrylics, and polyolefins.

As used herein, the term "weight percent" refers to a percentage calculated by dividing the weight of a material of a mixture by the total weight of the mixture and multiplying this quotient by 100.

As used herein, the term "percent add-on" refers to the percent of material added to a substrate after undergoing a treatment. The percent add-on is calculated by subtracting the pre-treatment weight ($W_o$) from the dried post-treatment weight ($W_t$) and dividing this difference by the pre-treatment weight ($W_o$). This quotient is than multiplied by 100 to obtain the percent add-on. A formula for calculating the percent add-on is depicted below:

$$\text{Percent Add-on} = \frac{(W_t) - (W_o)}{(W_o)} * 100$$

As used herein, the term "percent reduction in bond strength" refers to the percent reduction in maximum peel load by calculating the maximum peel load difference between a treated and an untreated substrate, dividing this difference by the maximum peel load of the untreated substrate, and multiplying this quotient by 100.

As used herein, the term "peel strength" refers to the maximum peel load, expressed in grams, required to separate tape from a paper machine substrate at about 180 degree angle over a distance of 2 inches (5.08 centimeters).

SUMMARY OF THE INVENTION

The problems and needs described above are addressed by the present invention, which provides a paper machine substrate. The paper machine substrate may include a grafted active agent that lowers the surface energy of the paper machine substrate for resisting the adhesion of stickies. Furthermore, the paper machine substrate may have a permeability sufficient to permit the passage of water therethrough. Moreover, the paper machine substrate may further include a polymer, such as polyethylene terephthalate or nylon. Also, the paper machine substrate may further include a metal. What is more, the substrate may have a surface energy sufficiently low to exhibit repellency to isopropyl alcohol.

In addition, the grafted active agent may be a fluorinated monomer. Some fluorinated monomers may have the chemical formula:

$$CH_2{=}CROCO(CH_2)_x(C_nF_{2n+1})$$

wherein n is an integer ranging from 1 to 8, x is an integer ranging from 1 to 8, and R is H or $CH_3$. What is more, the fluorinated monomer may be selected from the group including 2-Propenoic acid, 2,2,3,3,4,4,5,5,6,6,7,7,8,8,8-pentadecafluorooctyl ester; 2-Propenoic acid, 2-methyl-2,2,3,3,4,4,5,5,6,6,7,7,8,8,8-pentadecafluorooctyl ester; 2-Propenoic acid, pentafluoroethyl ester; 2-Propenoic acid, 2-methyl-, pentafluorophenyl ester; Benzene, ethenylpentafluoro-; 2-Propenoic acid, 2,2,2-trifluoroethyl ester; and 2-Propenoic acid, 2-methyl-, 2,2,2-trifluoroethyl ester.

Alternatively, the grafted active agent is selected from the group comprising fluorinated polymers, perfluorinated polymers, and polyalkyl siloxanes.

Another embodiment of the present invention is a process of making a treated paper machine substrate. The process may include the steps of providing a paper machine substrate, applying an active agent to the paper machine substrate, and exposing the paper machine substrate to greater than about 2 million rads (Mrad) of radiation.

Furthermore, the paper machine substrate may have a permeability sufficient to permit the passage of water therethrough. In addition, the paper machine substrate may further include a polymer, such as polyethylene terephthalate or nylon. What is more, the paper machine substrate may further include a metal.

In addition, the active agent may be a fluorinated monomer. Some such fluorinated monomers may have the chemical formula:

$$CH_2{=}CROCO(CH_2)_x(C_nF_{2n+1})$$

wherein n is an integer ranging from 1 to 8, x is an integer ranging from 1 to 8, and R is H or $CH_3$. The fluorinated monomers may be selected from the group including 2-Propenoic acid, 2,2,3,3,4,4,5,5,6,6,7,7,8,8,8-pentadecafluorooctyl ester; 2-Propenoic acid, 2-methyl-2,2,3,3,4,4,5,5,6,6,7,7,8,8,8-pentadecafluorooctyl ester; 2-Propenoic acid, pentafluoroethyl ester; 2-Propenoic acid, 2-methyl-, pentafluorophenyl ester; Benzene, ethenylpentafluoro-; 2-Propenoic acid, 2,2,2-trifluoroethyl ester; and 2-Propenoic acid, 2-methyl-, 2,2,2-trifluoroethyl ester.

Alternatively, the active agent is selected from the group comprising fluorinated polymers, perfluorinated polymers, and polyalkyl siloxanes.

Another embodiment of the present invention is a treated paper machine substrate. The treated paper machine substrate may be made by the steps including providing a paper machine substrate and grafting an active agent to the substrate that lowers the surface energy of the paper machine substrate for resisting the adhesion of stickies.

DETAILED DESCRIPTION OF THE PREFERRED EMBODIMENT(S)

The present invention may be used to modify paper machine substrates, such as forming wires, press felts, and through-dryer belts. These substrates may be manufactured from metals, such as steel or iron, natural fibers, such as wool, polymers, or mixtures thereof. Polymers used to manufacture substrates may include polyolefins, such as polyethylene or polypropylene, polyamide polymers, such as nylon, and polyesters, such as polyethylene terephthalate, or mixtures thereof. Generally, the paper machine substrates are woven materials permitting the passage of water therethrough.

In one desired embodiment, the paper machine substrates are modified by applying a solution and exposing the treated substrate to gamma rays, or desirably, electron beam induced grafting. The solution may include an active agent and solvent. Active agents may include fluorinated monomers, fluorinated polymers, perfluorinated polymers, and polyalkyl siloxanes.

Exemplary fluorinated monomers include 2-Propenoic acid, 2,2,3,3,4,4,5,5,6,6,7,7,8,8,8-pentadecafluorooctyl ester; 2-Propenoic acid, 2-methyl-2,2,3,3,4,4,5,5,6,6,7,7,8,8, 8-pentadecafluorooctyl ester; 2-Propenoic acid, pentafluoroethyl ester; 2-Propenoic acid, 2-methyl-, pentafluorophenyl ester; Benzene, ethenylpentafluoro-; 2-Propenoic acid, 2,2,2-trifluoroethyl ester; and 2-Propenoic acid, 2-methyl-, 2,2,2-trifluoroethyl ester.

Other fluorinated monomers that may be used in the solution have the general structure of:

$$CH_2{=}CROCO(CH_2)_x(C_nF_{2n+1})$$

wherein n is an integer ranging from 1 to 8, x is an integer ranging from 1 to 8, and R is H or $CH_3$. In many instances, the fluoroacrylate monomer may be comprised of a mixture of homologues corresponding to different values of n.

Monomers of this type may be readily synthesized by one of skill in the chemical arts by applying well-known techniques. Additionally, many of these materials are commercially available. The DuPont Corporation of Wilmington, Del. sells a group of fluoroacrylate monomers under the trade name ZONYL®. These agents are available with different distributions of homologues. More desirably, ZONYL® agents sold under the designation "TA-N" and "TM" may be used in the practice of the present invention.

Solvents used in the present invention may include halogens, ketones, esters, such as ethyl acetate, and ethers, such as diethyl ether, and water. Halogens may include chloroform, methylene chloride, perchloroethylene, and halogens sold under the trade designation FREON® by the DuPont Corporation. Ketones may include acetone and methyl ethyl ketone.

The weight percent of active agent in solution may range from about 0.1 percent to about 50 percent. Desirably, the weight percent of active agent in solution may range from 9 about 0.5 percent to about 20 percent. More desirably, the weight percent of active agent in solution may range from about 1 percent to about 10 percent.

After impregnating or saturating the paper machine substrates with the solution, the substrates are exposed to electron beam radiation, which results in the grafting of the active agent to the substrate. One exemplary electron beam apparatus is manufactured under the trade designation CB 150 ELECTROCURTAIN® by Energy Sciences Inc. of Wilmington, Mass. This equipment is disclosed in U.S. Pat. Nos. 3,702,412; 3,769,600; and 3,780,308; which are hereby incorporated by reference.

Generally, the substrates may be exposed to an electron beam operating at an accelerating voltage from about 80 kilovolts to about 350 kilovolts. Desirably, the accelerating voltage may be from about 80 kilovolts to about 250 kilovolts. More desirably, the accelerating voltage is about 175 kilovolts. The substrate may be irradiated from about 0.1 million rads (Mrad) to about 20 million rads (Mrad). Desirably, the substrates may be irradiated from about 0.5 Mrad to about 10 Mrad. More desirably, the substrates may be irradiated from about 2 Mrad to about 5 Mrad.

Alternatively, the active agent, such as ZONYL® TA-N agent may be heated to liquid form. This liquid may be applied with or without a solvent, such as acetone, directly to the substrate with vacuum assistance. Once the monomer is applied the substrate, it could be irradiated.

Generally, if the substrate is a polymer, the electron beam radiation causes a reaction between the active agent and substrate. As a result, the active agent may become grafted and/or crosslinked to the substrate.

EXAMPLES

A woven, polyethylene terephthalate substrate was saturated with a 30 weight percent ZONYL® TA-N active agent solution. The solvent used was acetone. The substrate was saturated with the solution and passed between two rubber nip rolls on a lab wringer. The nip rolls were operating under an absolute pressure of about 10 pounds per square inch (69,000 Pascals). Afterwards, the substrates were passed through the electron beam apparatus operating at about 175 kilovolts and irradiated to about 5 million rads. Next, the samples were dried to a constant weight.

Three other examples of the present invention were made in substantially the same manner, but about 1, about 5, and about 10 weight percent ZONYL® TA-N active agent in acetone solutions were respectively applied to woven, polyethylene terephthalate substrates.

The percent add-on of active agent to the substrate ranged from about 0.5 percent to about 40 percent. Desirably, the add-on percent may range from about 0.5 weight percent to about 5 weight percent, or more desirably, may range from 1 weight percent to about 3 weight percent.

TESTING

Three tests were undertaken with substrates produced by the present invention. These tests were tape adhesion, isopropyl alcohol repellency, and maximum peel load.

The tape adhesion test included placing about a 3 square inch (19 square centimeter) to about a 5 square inch (32 square centimeter) piece of tape on a substrate and seeing if adhesion occurred. The tape used was duct tape manufactured by Manco Inc. of Avon, Ohio.

The isopropyl alcohol repellency test required placing a 0.1 milliliter droplet of 100 percent isopropyl alcohol via a micro-syringe onto a substrate. The droplet was observed for absorption by or wetting of the substrate surface.

The maximum peel load measured the attachment strength of tape adhered to a paper machine substrate. The tape simulated "stickies" that may come into contact with a paper machine substrate during papermaking. The amount of bonding between the tape and substrate was determined by measuring the force required to separate the tape from the substrate. Results were expressed in units of grams of force where lower numbers indicate less attachment between the tape and substrate.

In this procedure, a tape applied to a substrate having a width of 4 inches (10.16 centimeters) and a length of 6 inches (15.24 centimeters) is manually separated for a distance of approximately 2 inches (5.08 centimeters). The tested substrates had a minimum length of about 6 inches (15.24 centimeters). A loose end of tape and a portion of the substrate were clamped into a respective jaw of a constant rate of extension (CRE) unit or tensile tester and the specimen was then subjected to a constant rate of extension. The average peel strength required to separate the tape from the substrate was determined and recorded as the peel strength of the specimen.

Special measures undertaken included maintaining a sharp die cutter. Sharpening a die may alter the actual cutting dimensions and subsequent test results. Therefore, the manufacturer was contacted for the recommended sharpening instructions. Furthermore, all edges on the specimen must be clean cut and parallel.

The equipment included the CRE unit along with an appropriate load cell and computerized data acquisition system. An exemplary CRE unit is sold under the trade designation SINTECH 2 manufactured by Sintech Corporation, whose address is 1001 Sheldon Drive, Cary, N.C. 27513. The type of load cell was chosen for the tensile tester being used and for the type of material being tested. The selected load cell had values of interest falling between the manufacturer's recommended ranges, namely between 10 percent and 90 percent, of the load cell's full scale value. The load cell and the data acquisition system sold under the trade designation TestWorks™ may be obtained from Sintech Corporation as well. The equipment was calibrated by consulting the equipment manufacturers or their literature.

Additional equipment included pneumatic-actuated jaws, a weight hanging bracket, a die cutter, and masking tape. The jaws were designed for a maximum load of 5000 g and may be obtained from Sintech Corporation. The weight hanging bracket was a substantially flat bracket, which was inserted into the jaws during calibration or set-up. The die cutter was used with a 4 inch (10.2 centimeter) by 6 inch (15.2 centimeter) die. An exemplary die cutter or cutting press is sold under the trade designation SWING BEAM by USM Corporation of Atlanta, Ga. 30328. An exemplary die may be obtained from Progressive Service Die Co., of Jacksonville, N.C. 28546. Masking tape being 4 inches (10.2 centimeters (cm)) wide and sold under the trade designation TARTAN 200 may be obtained from the 3M Corporation of St. Paul, Minn. 55144.

Tests were conducted in a standard laboratory atmosphere of 23±2° C. (73.4±3.6° F.) and 50±5% relative humidity.

The substrates were cut with the die to a width of 4 plus or minus 0.05 inches (102 plus or minus 1 millimeters) and a length of at least 6 inches (152 millimeters (mm)).

The specimens were prepared by applying a 4-inch (102 millimeter) wide masking tape to a substrate. The tape was applied matching the width of the tape with the width of the substrate to completely cover the length of the substrate. Next, the tape was hand smoothed firmly to ensure an even attachment to the specimen. The tape was applied as one uniform piece and not as multiple pieces of tape.

The CRE was set-up with the following parameters. The load cell was chosen with the appropriate size such that the peak load value would fall between 10% and 90% of the full scale load. The full scale load varied depending on load cell. The crosshead speed was chosen at 12+0.4 inches/minute (min) (300+10 mm/min). The start measurement was at 16 plus or minus 1 mm and the end measurement was at 170 plus or minus 1 mm. The sample width was 4 plus or minus 0.04 inches (102 plus or minus 1 mm). The gage length was 2 plus or minus 0.04 inches (51 plus or minus 1 mm). The test result was reported in grams.

The computer data acquisition system was set to verify that the appropriate load cell and grip faces were in the constant rate extender. Next, the load cell was warmed-up for a minimum of 30 minutes. Afterward, the software was booted up. Next, the arrow keys were used to highlight the desired headings. Afterwards, the menu headings were followed to perform set-up.

The testing procedure included manually separating the tape from the substrate so the tape was peeled apart from the substrate for a distance of approximately 2 inches (51 millimeters) along the length of the specimen to give a working area of 4 inches (102 millimeters). The tape was peeled apart such that the tape and free end of the substrate easily inserted into each jaw. However, the tape was not peeled apart more than 2.5 inches because the test area would have been insufficient. The peeled, free end of the substrate was clamped in the moving jaw, while the peeled, free end of the tape was placed in the stationary jaw at about 180 degrees from the peeled end of the substrate. The specimen was placed in the jaws straight and without slack.

Next, the crosshead was started. When the test was completed, the results were printed out, and included the maximum peel load, which was reported as the peel strength.

The tape adhesion and repellancy tests were undertaken with two samples of woven, polyethylene terephthalate substrates, respectively, treated with 1 and 30 weight percent ZONYL® TA-N active agent solution dissolved in an acetone solvent. These samples were compared with a control consisting of an untreated woven, polyethylene terephthalate substrate. Five specimens were tested for each data point representing the samples and control in TABLE 1, which are depicted below:

TABLE 1

| Material | Adhesion | Repellency |
|---|---|---|
| Control | yes | no |
| Treated (1 Wt. Percent) | no | yes |
| Treated (30 Wt. Percent) | no | yes |

As depicted in Table 1, both treated substrates repelled the isopropyl alcohol. The droplet of alcohol failed to penetrate or spread across the substrate, rather it beaded on the surface. In addition, the tape failed to adhere to the treated substrate.

However, the alcohol droplet spread or wetted the surface of the control substrate. Moreover, the tape adhered to the control surface when applied.

Thus, the failure of the tape to adhere and the repellency of the isopropyl alcohol to the treated substrate illustrates the treated substrates' low surface energy properties, and thereby correspondingly shows the treated substrates' ability to resist stickies adhesion.

The maximum peel load test was undertaken for four sample groups. The resulting peel load values were used to calculate the reduction in bond strength percents. The first group was a control consisting of an untreated woven, polyethylene terephthalate substrate. The second group was a woven, polyethylene terephthalate substrate treated with 1 weight percent ZONYL® TA-N active agent solution with an acetone solvent. The third group was a woven, polyethylene terephthalate substrate treated with 5 weight percent ZONYL® TA-N active agent solution with an acetone solvent. The fourth group was a woven, polyethylene terephthalate substrate treated with 10 weight percent ZONYL® TA-N active agent solution with an acetone solvent.

Each data point depicted in TABLE 2 represents the mean of three samples, as depicted below:

TABLE 2

| Concentration of Agent in Solution Used To Treat The Substrate (wt. %) | Peel Strength (g) | Reduction In Bond Strength (%) |
|---|---|---|
| 0 | 69 | 0 |
| 1 | 64 | 7 |
| 5 | 44 | 36 |
| 10 | 49 | 29 |

As depicted in TABLE 2, samples having been treated with greater than about 5 weight percent have about a third less bond strength than those samples having been treated with less than about 5 weight percent. This is clearly illustrated by the 5 and 10 weight percent treated samples having, respectively, a 36 percent and 29 percent reduction in bond strength from an untreated substrate. Thus, an inference may be drawn that the 5 and 10 weight percent treated samples would have less stickies adhesion than the untreated sample.

Although the inventors do not wish to held to a particular theory, it is believed that polyester paper machine substrates tend to have a surface energy of about 45 dynes/centimeter. Modifying the substrates with the treatment of the present invention lowers the surface energy of the substrate, thus impeding the wetting of the substrate with stickies. After treatment, it is believed that the surface energy of the paper machine substrate is less than about 20 dynes/centimeter.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents.

We claim:

1. A process for making a treated paper machine substrate comprising the steps of:

providing a paper machine substrate for transporting fibers during a papermaking process;

applying an active agent selected from the group consisting of fluorinated monomers, fluorinated polymers, perfluorinated polymers, and polyalkyl siloxanes onto a surface of said paper machine substrate, wherein the percent add-on of said active agent to said substrate is from about 0.5% to about 5%; and exposing said paper machine substrate to from about 2 Mrads to about 5 Mrads of radiation.

2. A process for making a treated paper machine substrate comprising the steps of:

providing a paper machine substrate for transporting fibers during a papermaking process;

applying an active agent selected from the group consisting of fluorinated monomers, fluorinated polymers, perfluorinated polymers, and polyalkyl siloxanes onto a surface of said paper machine substrate; and exposing said paper machine substrate to greater than about 2 Mrads of radiation.

3. The process of claim 2, wherein the active agent is a fluorinated monomer.

4. The process of claim 2, wherein the active agent is selected from the group consisting of fluorinated polymers, perfluorinated polymers, and polyalkyl siloxanes.

5. The process of claim 2, wherein the percent add-on of said active agent to said substrate is from about 0.5% to about 5%.

6. The process of claim 2, wherein the substrate is exposed to from about 2 Mrads to about 5 Mrads of said radiation.

7. A process of making a treated paper machine substrate comprising the steps of:

providing a paper machine substrate;

applying an active agent to the paper machine substrate; and exposing the paper machine substrate to greater than about 2 million rads (Mrad) of radiation to cause a reaction between the active agent and the substrate so the active agent becomes joined to the substrate.

8. The process of claim 7, wherein the substrate is exposed to from about 2 Mrads to about 5 Mrads of said radiation.

9. The process of claim 7, wherein the percent add-on of said active agent to said substrate is from about 0.5% to about 5%.

10. The process of claim 7, wherein the substrate has a surface energy sufficiently low to exhibit repellency to isopropyl alcohol.

11. The process of claim 7, wherein the substrate is formed from a polymeric material.

12. The process of claim 7, wherein the substrate has a permeability sufficient to permit the passage of water therethrough.

13. The process of claim 7, wherein the substrate is a nonwoven material.

14. The process of claim 7, wherein the paper machine substrate is made of polyethylene terephthalate or nylon.

15. The process of claim 7, wherein the paper machine substrate is made of a metal.

16. The process of claim 7, wherein the active agent is a fluorinated monomer.

17. The process of claim 16, wherein the fluorinated monomer has the chemical formula:

$$CH_2{=}CROCO(CH_2)_x(C_nF_{2n+1})$$

wherein n is an integer ranging from 1 to 8, x is an integer ranging from 1 to 8, and R is H or $CH_3$.

18. The process of claim 16, wherein the fluorinated monomer is selected from the group consisting of 2-Propenoic acid, 2,2,3,3,4,4,5,5,6,6,7,7,8,8,8-pentadecafluorooctyl ester; 2-Propenoic acid, 2-methyl-2,2,3,3,4,4,5,5,6,6,7,7,8,8,8-pentadecafluorooctyl ester; 2-Propenoic acid, pentafluoroethyl ester; 2-Propenoic acid, 2-methyl-, pentafluorophenyl ester; Benzene, ethenylpentafluoro-; 2-Propenoic acid, 2,2,2-trifluoroethyl ester; and 2-Propenoic acid, 2-methyl-, 2,2,2-trifluoroethyl ester.

19. The process of claim 7, wherein the active agent is selected from the group consisting of fluorinated polymers, perfluorinated polymers, and polyalkyl siloxanes.

20. The process of claim 7, wherein the substrate is a woven material.

* * * * *